US007830337B2

(12) United States Patent
Choi et al.

(10) Patent No.: US 7,830,337 B2
(45) Date of Patent: Nov. 9, 2010

(54) METHOD AND APPARATUS FOR DRIVING AC PLASMA DISPLAY PANEL WITH FOUR ELECTRODES

(75) Inventors: Kyung Cheol Choi, Yongin-si (KR); Jin Bhum Yun, Uijeongbu-si (KR)

(73) Assignee: Korean Advanced Institute of Science and Technology (KAIST), Daejeon (KR)

( * ) Notice: Subject to any disclaimer, the term of this patent is extended or adjusted under 35 U.S.C. 154(b) by 827 days.

(21) Appl. No.: 11/726,730

(22) Filed: Mar. 22, 2007

(65) Prior Publication Data

US 2007/0222714 A1 Sep. 27, 2007

(30) Foreign Application Priority Data

Mar. 23, 2006 (KR) ..... 10-2006-0026418

(51) Int. Cl.
*G09G 3/38* (2006.01)
*G09G 3/10* (2006.01)

(52) U.S. Cl. ..... 345/60; 345/37; 345/41; 315/169.4

(58) Field of Classification Search ..... 345/60–69, 345/37, 41; 315/169.1–169.4
See application file for complete search history.

(56) References Cited

U.S. PATENT DOCUMENTS 6,717,557 B2 * 4/2004 Ishizuka ..... 345/60
7,176,852 B2 * 2/2007 Tachibana et al. ..... 345/60
7,616,176 B2 * 11/2009 Yi et al. ..... 345/67
2002/0084953 A1 * 7/2002 Yoon et al. ..... 345/60
2005/0116899 A1 * 6/2005 Chae et al. ..... 345/60
2005/0140589 A1 * 6/2005 Yi et al. ..... 345/63
2005/0264475 A1 * 12/2005 Yim ..... 345/60
2006/0001606 A1 * 1/2006 Yim ..... 345/63
2006/0061523 A1 * 3/2006 Kim et al. ..... 345/67
2006/0066520 A1 * 3/2006 Itokawa et al. ..... 345/67

* cited by examiner

*Primary Examiner*—David L Lewis
*Assistant Examiner*—Benyam Ketema
(74) *Attorney, Agent, or Firm*—The Webb Law Firm

(57) ABSTRACT

The present invention provides a driving method of a plasma display panel with ADS method comprising a reset period including an erase period, a rising period and a falling period, an address period and a sustain period, in which an auxiliary electrode is inserted between a scan electrode and a sustain electrode which are disposed in parallel on a front substrate, while an address electrode is disposed on a rear substrate facing the front substrate, wherein an erase pulse which rises from a first voltage to a second voltage is applied to the auxiliary electrode in the erase period. According to the present invention, the reset driving method is used in a four electrode AC PDP for a high efficiency, in which the reset discharge is stabilized by lowering the reset voltage, thereby, the address discharge is stabilized. Thus, the four electrode AC PDP having a high efficiency can be stably drived. The plasma display panel using the method uses a low reset voltage, so that the power consumption is reduced. Hence, the total energy efficiency is increased and a high definition PDP can be implemented due to a stable addressing.

4 Claims, 9 Drawing Sheets

(a) (b) (c)

(a) (b) (c)

METHOD AND APPARATUS FOR DRIVING AC PLASMA DISPLAY PANEL WITH FOUR ELECTRODES

CLAIM FOR PRIORITY

This application is based on and claims priority to Korean Patent Application No. 10-2006-0026418 filed on Mar. 23, 2006 in the Korean Intellectual Property Office (KIPO), the entire contents of which are hereby incorporated by reference.

BACKGROUND OF THE INVENTION

1. Field of the Invention

The present invention relates to a reset driving method of an alternating current plasma display panel (hereinafter, PDP) having four electrode, in particular, to a novel driving method for AC PDP and AC PDP using the driving method, in which the driving method of a four electrodes surface discharge alternating current plasma display panel (hereinafter, four electrodes surface discharge AC PDP) where an auxiliary electrode is inserted between a scan electrode and a sustain electrode of a three electrodes surface discharge alternating current plasma display panel of the related art (hereinafter, a three electrode surface discharge AC PDP) is improved, thereby, a stable reset discharge can be generated by lowering the reset voltage, and a stable address operation can be performed.

2. Description of the Related Art

FIG. 1 is a drawing illustrating an example of the configuration of a discharge cell of three electrode surface discharge AC PDP.

As shown in FIG. 1, a scan electrode 23 and a sustain electrode 27 which are covered with a dielectric layer 19 and a protection layer 17 on a front glass substrate are disposed in parallel to form a pair.

An address electrode 10 which is covered with a dielectric layer 13 exists on a rear glass substrate, while a barrier rib 15 is formed in parallel with the address electrode 10. A phosphor is disposed on the surface of the dielectric layer 13 and both sides of the barrier rib 15.

The front substrate 30 and the rear substrate 20 are coalesced in order that the scan electrode 23 and the sustain electrode 27 intersects with the address electrode 10. Thereby, a discharge space can be secured between the barrier ribs, so that the discharge space which is disposed in the intersection of the address electrode 10, the scan electrode 23 and the sustain electrode 27 forms a discharge cell.

FIG. 2 is a drawing illustrating a subfield driving method which is one of the driving methods for AC PDP of the related art.

In the AC PDP, an image is divided into a plurality of subfields to display a gray scale. FIG. 2 illustrates the control of $2^8$ gray scales. The ratio of the light emitting period of each subfield is set to be 1, 2, 4, 8, 16, 32, 64, 128. Accordingly, the gray scale can be displayed by the combination of the light emitting of each subfield.

Further, the operation in one subfield will be described. One subfield includes a reset period, an address period, and a sustain period. In an initialization period (reset period), the wall charges of a discharge cell where a sustain discharge is generated and a discharge cell where a sustain discharge is not generated is set to be uniform.

In the address period, a discharge cell is selected so as to perform a sustain discharge by performing a selective write or erase discharge. In the sustain period, in the cell selected in the address period, voltages are alternately applied to the scan electrode and the sustain electrode to perform a sustain discharge.

FIG. 3A is a drawing illustrating waveforms for driving in a three electrode surface discharge AC PDP. FIG. 3B is a drawing illustrating the change of the distribution of the wall charges in the reset period corresponding to the waveform (hereinafter, 'a first case').

Referring to FIG. 3A and FIG. 3B, the ADS (Addressing and Display Separated) subfield reset method in the three electrodes surface discharge AC PDP is described.

First, as to the wall charges and an application pulse in the erase period (1), after the application of the last pulse of the sustain discharge, positive charges are accumulated in the sustain electrode X, while negative charges are accumulated in the scan electrode Y and a lot of positive charges are accumulated in the address electrode A.

Immediately after the sustain discharge, the erase pulse of a ramp waveform is applied to the sustain electrode X so as to erase the wall charges which are formed after the sustain discharge, thereby, the wall charges are gradually erased due to the erase pulse (FIG. 3B (1)).

Second, as to the wall charges and an application pulse in the ramp-up period (2), a voltage of a ramp waveform which is higher than the firing voltage of the sustain electrode X and the scan electrode Y is applied to the scan electrode Y such that a weak reset discharge is generated in all discharges cells from the scan electrode Y to the sustain electrode X and the address electrode A.

Accordingly, negative charges are accumulated in the scan electrode Y, while positive charges are accumulated in the sustain electrode x and the address electrode A (FIG. 3B (2)).

Third, as to the wall charges and an application pulse in the ramp-down period (3), a ramp waveform having a gentle slope which is opposite to the slope in the ramp-up period is applied to the scan electrode Y, while the positive voltage is applied to the sustain electrode X such that a weak reset discharge is generated in all discharges cells.

Accordingly, the wall charges formed in the ramp-up period, that is, the wall charges (−) in the scan electrode Y and the wall charges (+) in the sustain electrode X are decreased, while the wall charges in the address electrode A is optimized for address operation in the next address period (FIG. 3B (3)).

When the driving waveform of the related art is used for forming wall charges suitable for the address operation by sufficiently accumulating a lot of (+) wall charges in the address electrode A and (−) wall charges in the scan electrode, the voltage of approximately 400V is required in case of AC PDP having 60 μm~80 μm gap of the sustain electrode X.

As described, since the efficiency of the three electrode AC PDP is low, the power consumption is high in case of the full screen light emitting, therefore, there is a problem in that the efficiency should be enhanced so as to lower the power consumption.

Accordingly, recently, the long gap discharge where the gap between the scan electrode and the sustain electrode is long is used. Hereinafter, the change of the distribution of the wall charges in the reset period due to the long gap discharge will be described.

FIG. 3C is a drawing illustrating the change of the distribution of the wall charges in the reset period in case, without an auxiliary electrode, the waveforms of the related art is applied to AC PDP having the coplanar gap (the gap between the scan electrode and the sustain electrode) of 200 μm (hereinafter, "a second case").

The erase pulse is applied to the sustain electrode X in the erase period (1), so that a little of (−) wall charges are accumulated in the scan electrode Y, while a little of (+) wall charges are accumulated in the address electrode A.

A rising voltage is applied to the scan electrode Y in the ramp up period (2), thereby, a discharge is generated between each electrodes. Accordingly, a lot of (−) wall charges are accumulated in the scan electrode Y, while the corresponding (+) wall charges are accumulated in the sustain electrode X and the address electrode A.

In addition, a falling voltage is applied to the scan electrode Y in the ramp down period (3), thereby, the wall charges which are accumulated in each electrodes can be erased.

However, in this case, as to the discharge between the scan electrode Y and the address electrode A, due to the long gap (the extension of the coplanar gap), the gap between the scan electrode Y and the address electrode A becomes relatively shorter than the gap between the sustain electrode X and the address electrode A, thereby, the discharge is more actively generated.

In result, the quantity of the wall charges which are accumulated in the address electrode A in of the erase period becomes smaller than the quantity of the wall charges in FIG. 3B.

In addition to the long gap electrode structure, for a high efficiency characteristic, with broadening the gap between the scan electrode Y and the sustain electrode X, a four electrode AC PDP where an auxiliary electrode is inserted between the scan electrode Y and the sustain electrode X has been suggested.

However, when AC PDP having the four electrode configuration is used with the driving method of the related art, the reset voltage is increased and the address discharge becomes unstable, thereby, there is a problem in that a stable operation can not be performed.

SUMMARY

To solve the above problems, the present invention provides a four electrode AC PDP using a novel driving method by an auxiliary electrode, in which a reset discharge becomes stable and the address discharge becomes stable by lowering the reset voltage such that the four electrodes AC PDP having a high efficiency can be stably driven.

According to an aspect of the present invention, provided is the driving method of a plasma display panel using ADS method comprising a reset period including an erase period, a rising period and a falling period, an address period and a sustain period, in which an auxiliary electrode is inserted between a scan electrode and a sustain electrode which are disposed in parallel on a front substrate, while an address electrode is disposed on a rear substrate facing the front substrate, wherein an erase pulse which rises from a first voltage to a second voltage is applied to the auxiliary electrode in the erase period.

In accordance with an aspect of the present invention, it is preferable that the reset period comprises applying a predetermined voltage to the sustain electrode in order that the potential difference with the scan electrode maintains a smaller voltage than a firing voltage, while the auxiliary electrode maintains a ground voltage with increasing the voltage which is applied to the scan electrode in the rising period; and respectively applying the predetermined voltage to the auxiliary electrode and the sustain electrode with decreasing the voltage which is applied to the scan electrode in the falling period.

Further, it is preferable that a last voltage of the falling period applied to the scan electrode and a basic (lowest) voltage applied to the sustain electrode and the auxiliary electrode are lowered than the ground voltage.

Additionally, it is also preferable that an erase pulse of ramp waveform including a rising period is applied to the sustain electrode in the erase period.

According to another aspect of the present invention, provided is a four electrode AC plasma display panel where an auxiliary electrode is inserted between a scan electrode and a sustain electrode which are disposed in parallel on a front substrate, while an address electrode is disposed on a rear substrate facing the front substrate, the four electrode AC plasma display panel using a reset driving method comprising applying an erase pulse which rises from a first voltage to a second voltage to the auxiliary electrode in an erase period; applying an uniform voltage to the sustain electrode in order that the potential difference with the scan electrode maintains a smaller voltage than a firing voltage, while the auxiliary electrode maintains a ground voltage with increasing the voltage which is applied to the scan electrode in the rising period; and respectively applying the predetermined voltage to the auxiliary electrode and the sustain electrode with decreasing the voltage which is applied to the scan electrode in the falling period.

BRIEF DESCRIPTION OF THE DRAWINGS

The invention will be described in detail with reference to the following drawings in which like numerals refer to like elements. The accompany drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE INVENTION

Reference will now be made in detail to embodiments of the present invention, examples of which are illustrated in the accompanying drawings.

Figure 4:
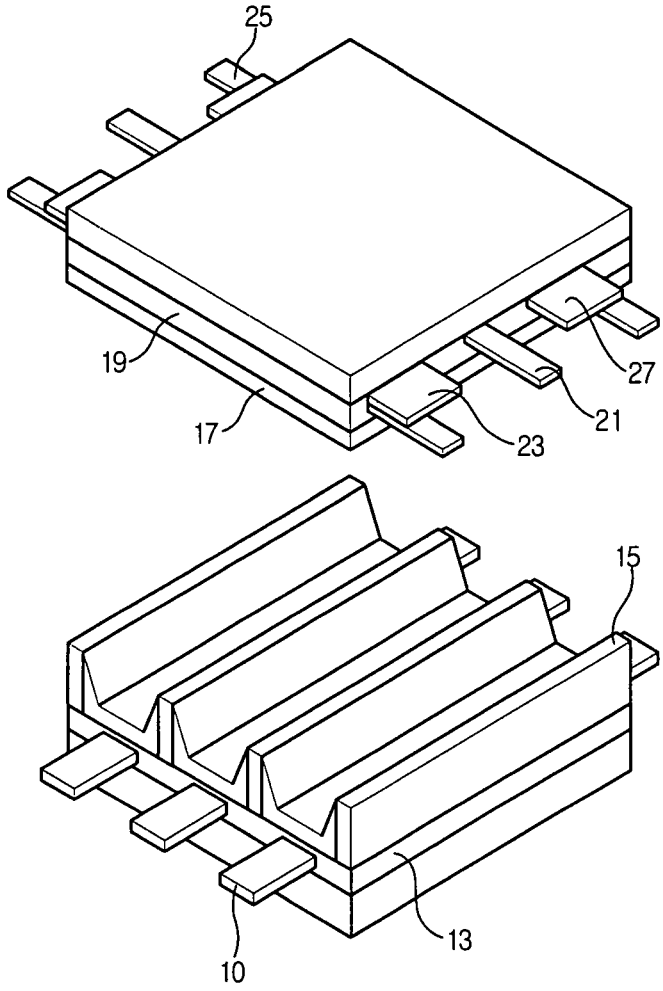
FIG. 4 is a drawing illustrating the configuration of the four electrode AC PDP where an auxiliary electrode is inserted between the scan electrode and the sustain electrode.

FIG. 4 is a perspective view illustrating the configuration of a four electrode surface discharge AC PDP.

As shown in FIG. 4, the configuration of the rear substrate is identical with the configuration of a three electrode surface discharge AC PDP. However, as to the front substrate, an auxiliary electrode 21 is inserted into the center of the sustain electrode 27 and the scan electrode 23 of the three electrode surface discharge AC PDP, and a dielectric layer 19 and a protection layer 17 are disposed thereon. Each of the scan electrode 23 and the sustain electrode 27 may include a conductive electrode 25 so as to reduce its resistance.

The gap between the sustain electrode 27 and the scan electrode 23 is elongated so as to induce the long gap discharge for increasing the efficiency. However, as the gap between the sustain electrode 27 and the scan electrode 23 increases, the operating voltage also increases.

In this case, it is an advantage that the operating voltage can be lowered by applying an auxiliary pulse to the auxiliary electrode 21.

However, as to the reset driving method of the related art with applying ramp waveform in the scan electrode 23, it is not avoidable that the reset voltage increases, thereby, it is a disadvantage that a stable address discharge can not be generated.

To solve the problems, with an auxiliary electrode 21 suggested in the present invention, by applying a ramp reset pulse and a bias voltage, the reset discharge can be stabilized such that the reset voltage can be lowered and the addressing can be stably performed.

Figure 5A:
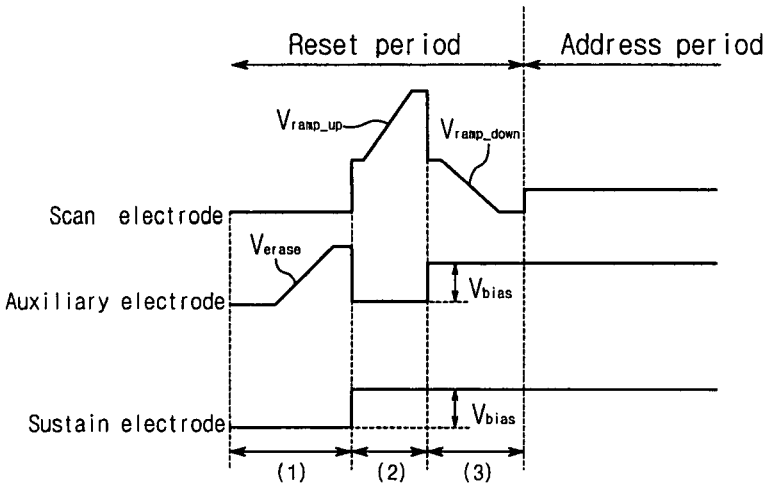
FIG. 5A is a drawing illustrating reset waveforms which is applied to each electrode in a four electrode surface discharge AC PDP according to the present invention.
Figure 5B:
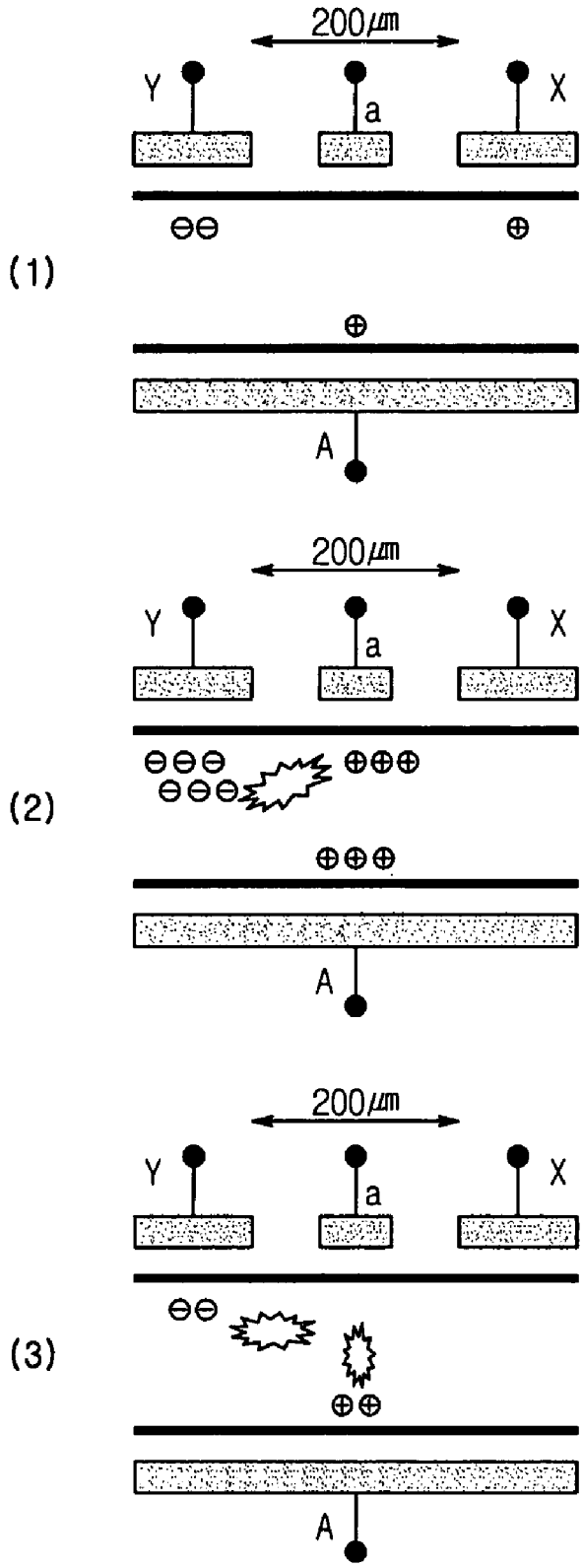
FIG. 5B is a drawing illustrating the change of the distribution of the wall charges in each electrode according to the reset waveforms of FIG. 5A.

FIG. 5A is a drawing illustrating reset waveforms which are applied to each electrode in a four electrode surface discharge AC PDP according to the present invention, and FIG. 5B is a drawing illustrating the change of the distribution of the wall charges in each electrode according to the reset waveforms of FIG. 5A (hereinafter, 'a third case').

Hereinafter, referring to FIG. 5A and FIG. 5B, a driving method according to the present invention will be described.

Firstly, as to the wall charge generation by the voltage applied to each electrode, after the end of the last sustain discharge, negative wall charges are accumulated in the scan electrode Y, while positive wall charges are accumulated in the sustain electrode X, the address electrode A, the auxiliary electrode a.

Immediately after the end of the sustain discharge, in case an erase ramp voltage $V_{erase}$ having a slope which increases from a first voltage to a second voltage is applied to the auxiliary electrode a, the wall charges which are accumulated in the scan electrode Y and the auxiliary electrode a are gradually erased, while the wall charges in the sustain electrode X still exist (FIG. 5B (1)).

As above, the erase pulse $V_{erase}$ is not applied to the sustain electrode X as the reset driving method of the related art, but applied to the auxiliary electrode a. Therefore, the wall charges accumulated in the scan electrode Y and the auxiliary electrode a are gradually erased, while the wall charges in the sustain electrode X still exist.

That is, due to the auxiliary electrode a, the wall charges are erased in the erase period which is a reset preparation step and proper wall charges are remained in the sustain electrode X.

In the next step, or in the ramp up period (2), the address electrode A and the auxiliary electrode a maintain 0V, while the sustain electrode X is applied with a predetermined voltage $V_{bias}$ so as not to generate a discharge with the scan electrode Y.

A voltage which is higher than the firing voltage with respect to the auxiliary electrode a is applied to the scan electrode Y with a ramp waveform $V_{erase}$ which gradually rises.

Therefore, a weak reset discharge is generated between the sustain electrode X and the auxiliary electrode a when the ramp voltage rises. Thereby, a lot of negative charges are accumulated in the scan electrode, while positive charges are accumulated in the auxiliary electrode a and the address electrode A and positive wall charges which are accumulated during the sustain discharge are decreased (FIG. 5B (2)).

In the last step of a reset period, or in the ramp down period (3), while the sustain electrode X and the auxiliary electrode a maintain a predetermined voltage $V_{bias}$, a voltage of a ramp waveform having a gentle slope which is opposite to the ramp up period is applied to the scan electrode Y with respect to the sustain electrode X.

When the ramp voltage falls, a weak reset discharge is generated in the scan electrode Y, the auxiliary electrode a, and the address electrode A.

Thereby, a lot of negative wall charges which are accumulated in the scan electrode Y is decreased, while positive wall charges which are suitable for the address operation are accumulated in the address electrode A (FIG. 5B (3)). As described, in case the long gap is used, the distribution of wall charges also becomes similar to the distribution of FIG. 3B.

Meanwhile, the slope of the ramp waveform ($V_{ramp_up}$, $V_{ramp_down}$) which is applied to the scan electrode Y during the ramp up period (2) and the ramp down period (3) relates to the quantity of the discharge.

It is preferable that the amount of the slope is the same for an uniform initialization of the discharge cell, however, it can be different due to the various factors such as the environmental condition of the cell. Further, it can be properly controlled through the driving circuit of the inner side.

The reset driving method of AC PDP with a four electrode configuration according to the present invention is capable of avoiding the increase of the generated reset discharge voltage by using the reset driving method of three electrode AC PDP of the related art.

Further, the stable reset discharge is induced, thereby, positive wall charges are properly accumulated in the address electrode A. Accordingly, a stable addressing can be performed by using a low voltage in the next address period.

That is, immediately after the reset period, the negative wall charges (−) are accumulated in the scan electrode Y, while the positive wall charges (+) are accumulated in the address electrode A. Therefore, the addressing which is suitable for each cell can be stably performed with a low voltage.

Figure 6:
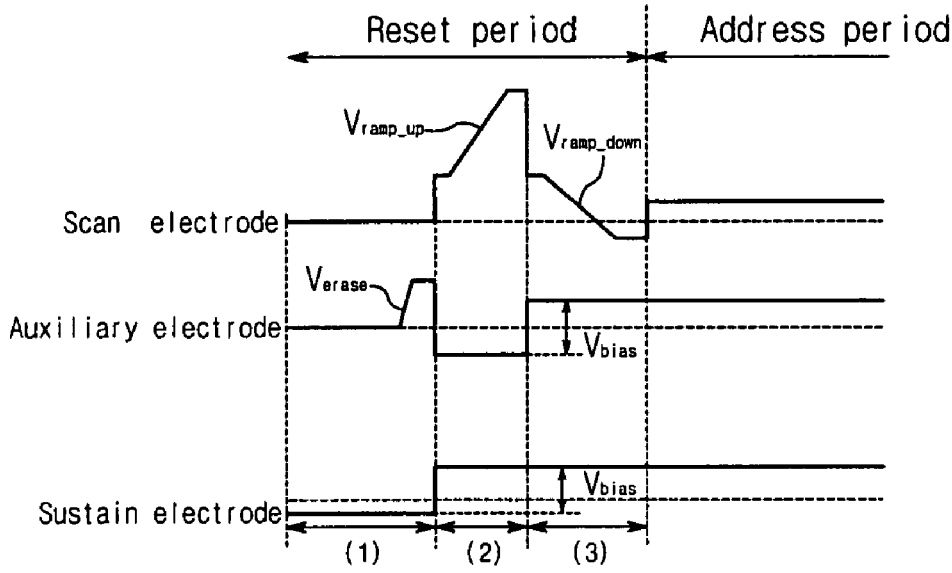
FIG. 6 is a drawing illustrating a driving waveform of a four electrode AC PDP where the ramp voltage is lowered and the more wall charges can be accumulated in the address electrode.

As another embodiment of the present invention, FIG. 6 is a drawing illustrating reset waveforms of a four electrode AC PDP where the ramp voltage is lowered and the more wall charges can be accumulated in the address electrode.

As shown in FIG. 6, as to the driving waveforms according to a first embodiment of the present invention, by lowering the last voltage of the ramp down period and the basic (lowest) voltage of the sustain electrode than the address voltage, that is, the ground voltage, the voltage of the ramp up period can be lowered, and wall charges can be more accumulated in the address electrode. Hence, the address discharge in the next step can be stabilized.

That is because the substantial potential difference between the scan electrode and the sustain electrode is similar to the potential difference between the scan electrode and the sustain electrode in FIG. 4, since the both voltages of the scan electrode and the sustain electrode is lower than the ground voltage.

Additionally, the wall charge generation and the erase are performed by the operation of the reset pulse which is identical with the embodiment of FIG. 6. However, since the basic (lowest) voltage of the auxiliary electrode and the sustain electrode is lower than the ground voltage, positive wall charges are relatively more accumulated in the address electrode due to the discharge which is generated by the application of the ramp waveform of the scan electrode.

Accordingly, the application voltage can be lowered so as to easily perform the addressing in the next address period.

Figure 7:
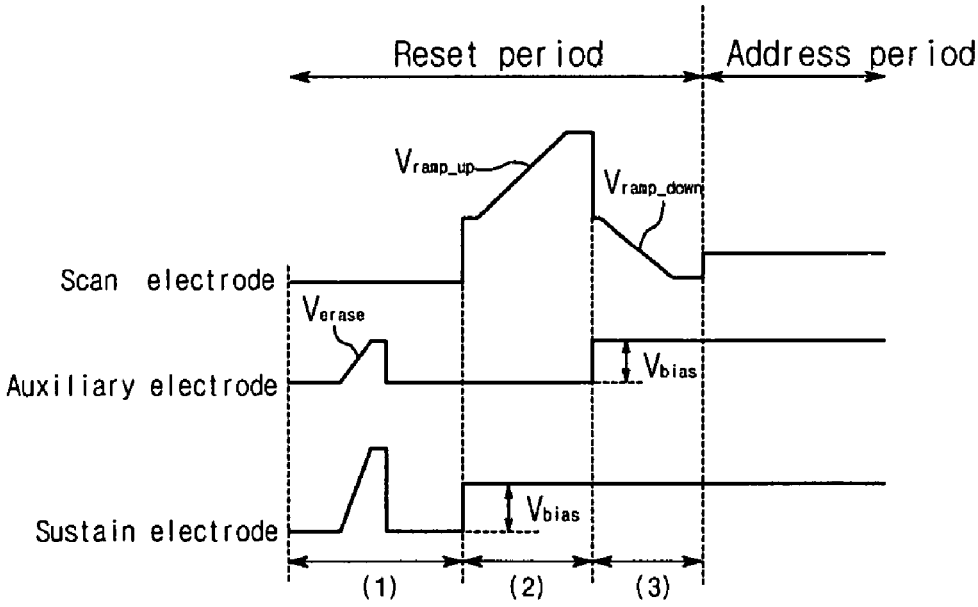
FIG. 7 is a drawing illustrating a driving waveform of AC PDP where erase pulses are simultaneously applied to an auxiliary electrode and a sustain electrode according to the present invention.

FIG. 7 is a drawing illustrating a reset driving waveform that erase pulses are simultaneously applied to an auxiliary electrode and a sustain electrode according to the present invention.

As a further embodiment of the present invention, wall charges of the sustain electrode which are accumulated in the sustain period can be previously erased in the ramp up period by applying the erase pulse to both the auxiliary electrode and the sustain electrode after the end of the sustain discharge.

As described, in case wall charges of the sustain electrode are previously erased, the predetermined voltage $V_{bias}$ for erasing wall charges of the sustain electrode can be lowered in the ramp down period.

According to the reset driving method, the reset voltage can be lowered, thereby, the reset discharge can be stabilized. Accordingly, the address discharge can be stabilized such that the high efficient four electrode AC PDP can be stably drived.

Further, as to the reset driving method of a four electrode AC Plasma Display Panel, the reset driving method includes an erase period where a voltage rising from a first voltage to a second voltage is applied to an auxiliary electrode; a rising period where the auxiliary electrode maintains a ground voltage with increasing the voltage applied to the scan electrode, while a predetermined voltage $V_{bias}$ is applied to the sustain electrode in order that the potential difference with the scan electrode maintains a smaller voltage than the firing voltage; and a falling period where the predetermined voltage $V_{bias}$ is applied to the auxiliary electrode and the sustain electrode, while the voltage applied to the scan electrode falls.

As to the four electrode AC Plasma Display Panel, it is an advantage that the efficiency can be increased due to the decrease of the power consumption by the use of the reset voltage. Further, a high definition PDP can be implemented through performing a stable addressing.

Hereinafter, the data which is applied by the four electrode AC Plasma Display Panel of the embodiment according to the present invention will be exemplified and will be describe.

Figure 1:
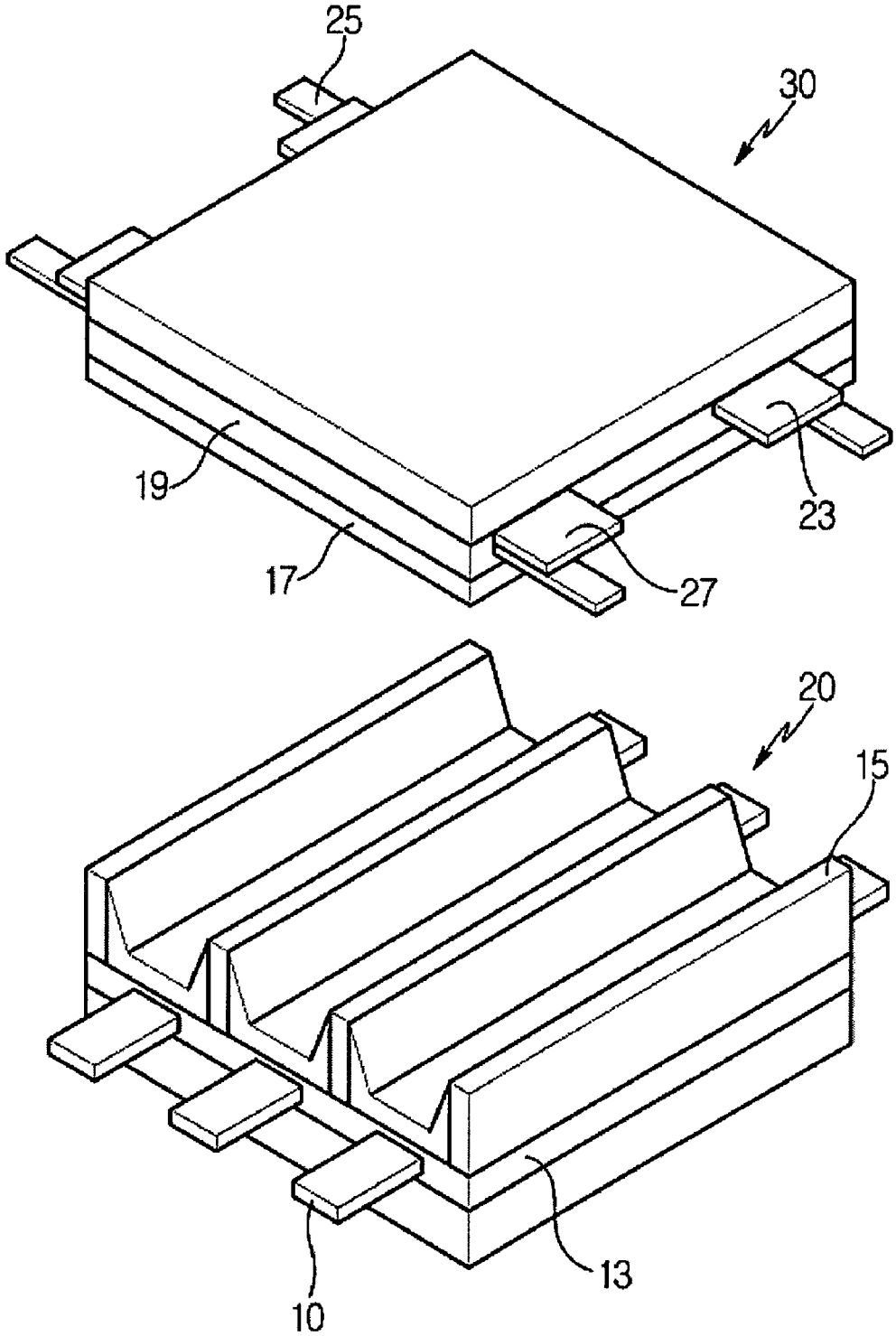
FIG.1 (RELATED ART)
FIG. 1 is a drawing illustrating an example of the configuration of a discharge cell of three electrode surface discharge AC PDP.
Figure 2:
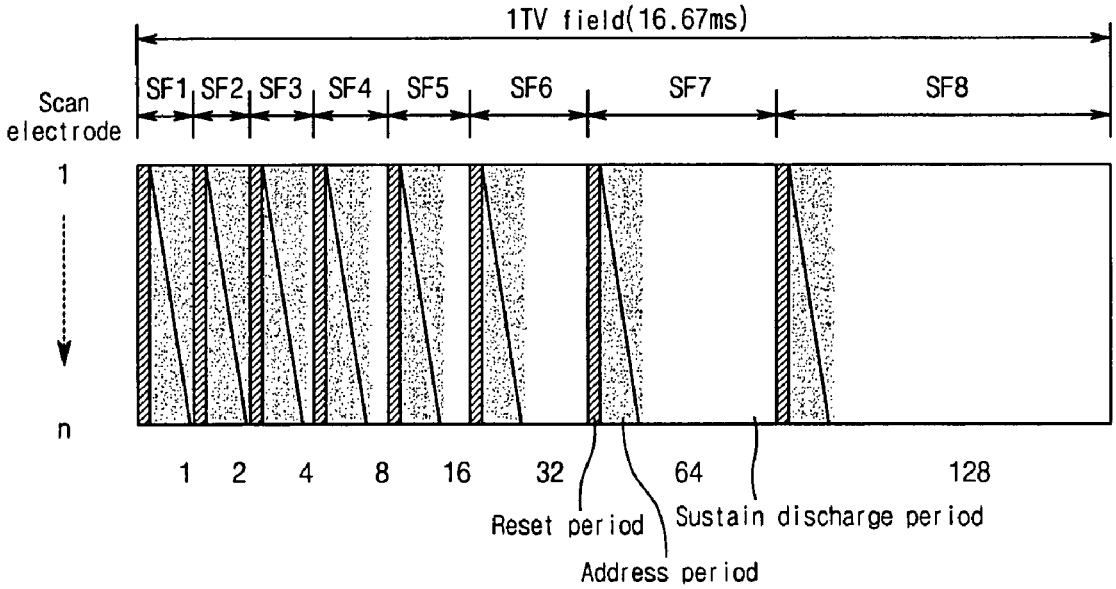
FIG.2 (RELATED ART)
FIG. 2 is a drawing illustrating a subfield driving method which is one of the driving methods for AC PDP of the related art.
Figure 3A:
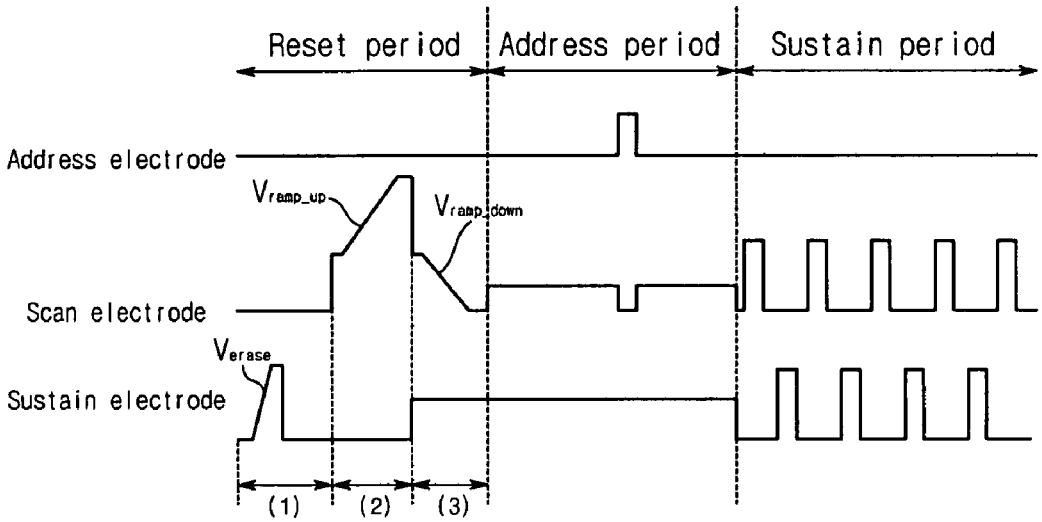
FIG.3A (RELATED ART)
FIG. 3A is a drawing illustrating waveforms for driving in a three electrodes surface discharge AC PDP.
Figure 3B:
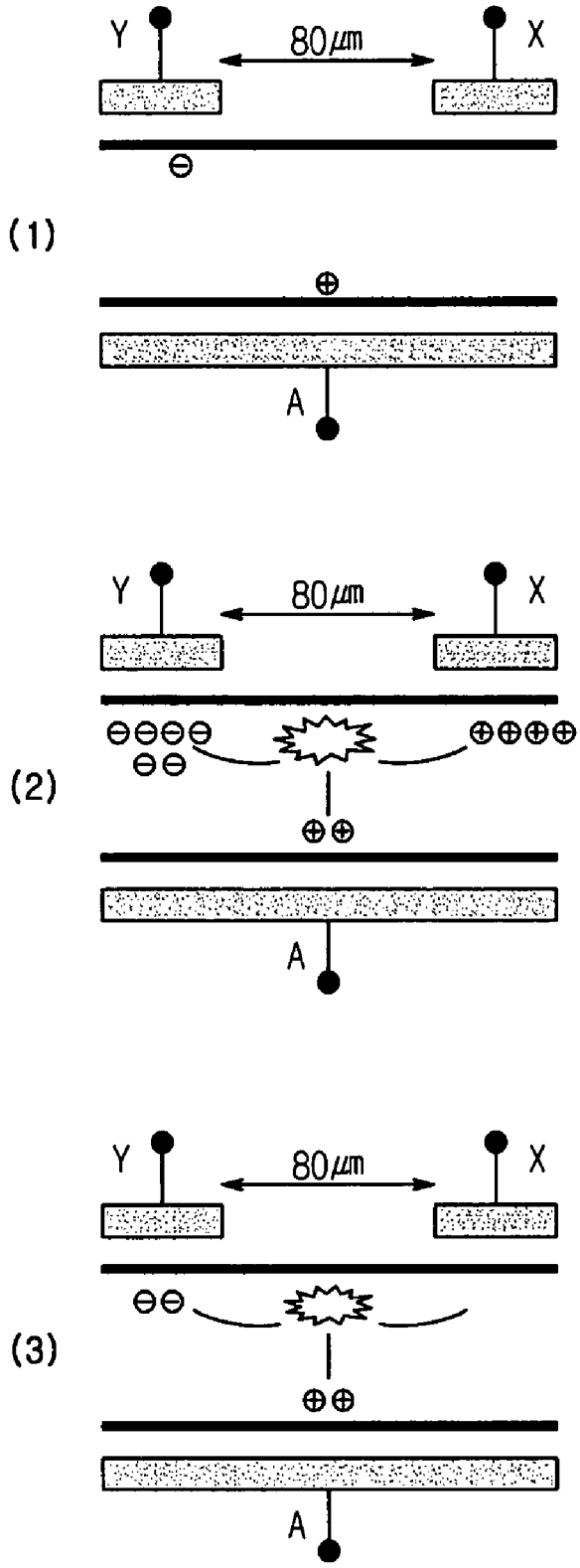
FIG.3B (RELATED ART)
FIG. 3B is a drawing illustrating the change of the distribution of the wall charges in the reset period corresponding to the waveforms.
Figure 3C:
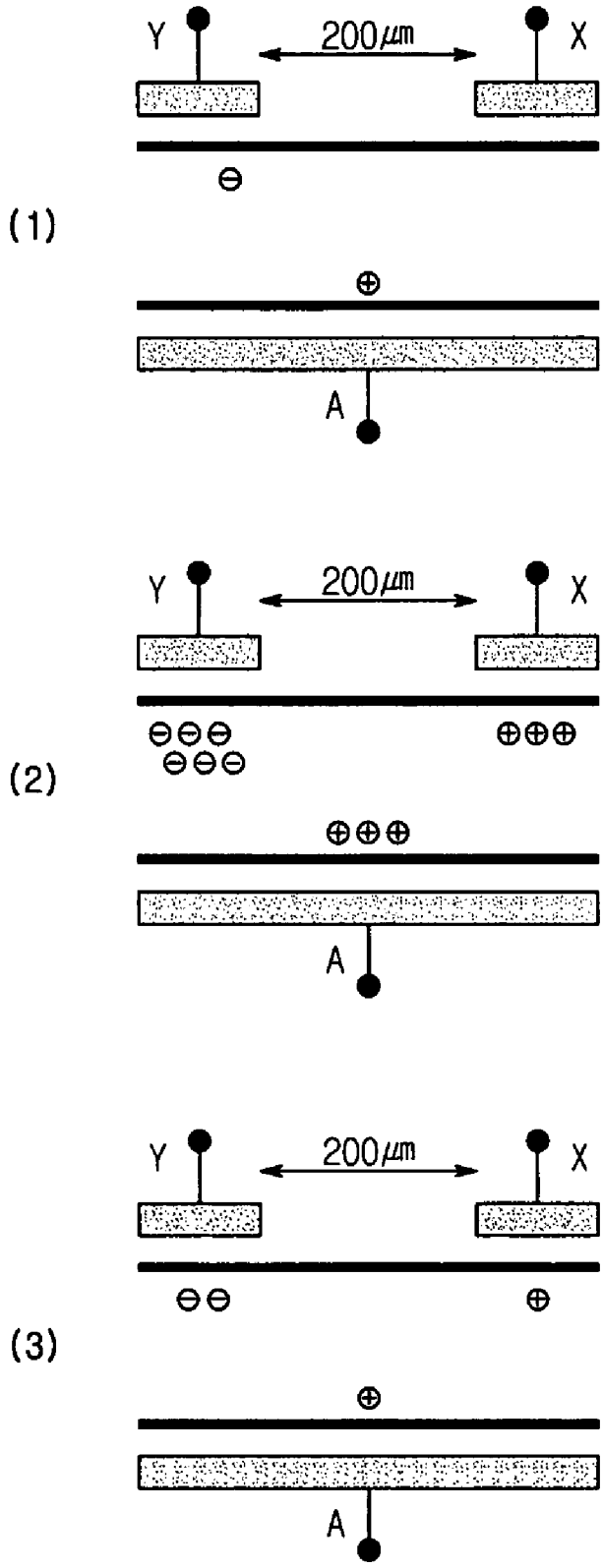
FIG.3C (RELATED ART)
FIG. 3C is a drawing illustrating the change of the distribution of the wall charges in the reset period in case, without an auxiliary electrode, the driving waveform of the related art is applied to AC PDP having the coplanar gap (the gap between the scan electrode and the sustain electrode) of 200 μm.
Figure 8:
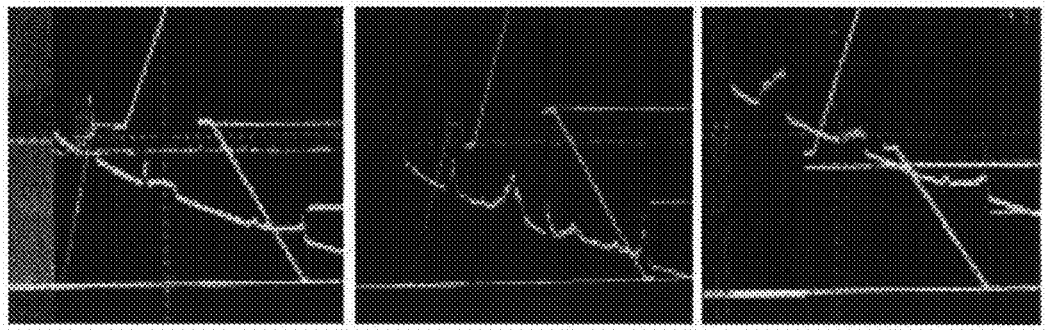
FIG. 8 is a picture illustrating the characteristic of IR (Infra Red) light emitting according to the driving waveform having the distribution of wall charges of FIG. 3B (a first case), FIG. 3C (a second case), and FIG. 5B (a third case).

FIG. 8 is a picture illustrating the characteristic of IR (Infra Red) light emitting according to the driving waveform having the distribution of wall charges of FIG. 3B (a first case), FIG. 3C (a second case), and FIG. 5B (a third case).

In FIG. 8, (a) is a picture illustrating the IR light emitting of the stable reset discharge of a three electrode AC PDP where the coplanar-gap of the related art is 80 μm (a first case).

In FIG. 8, (b) is a picture illustrating the IR light emitting of AC PDP where the coplanar-gap of the related art is 200 μm (a second case).

In FIG. 8, (c) is a picture illustrating the IR light emitting of a four electrode AC PDP where the coplanar-gap according to the present invention is 200 μm (a third case).

In this case, the reset peak voltage of the first case is 420V, while the reset peak voltage of the second case is 440V. In the second case, since the gap between the scan electrode and the sustain electrode is larger than the first case (a), the peak voltage increases to 440V. Compared with the first case (a), the more strong reset discharge is generated in the ramp up period and the ramp down period.

On the other hand, like the third case (c), in case the long gap discharge is induced with the auxiliary electrode which is inserted between the scan electrode and the sustain electrode, when the novel driving waveform according to the present invention is applied, the characteristic of the reset discharge which is identical with the first case (a) can be obtained without applying the high reset peak voltage like the second case (b).

Figure 9:
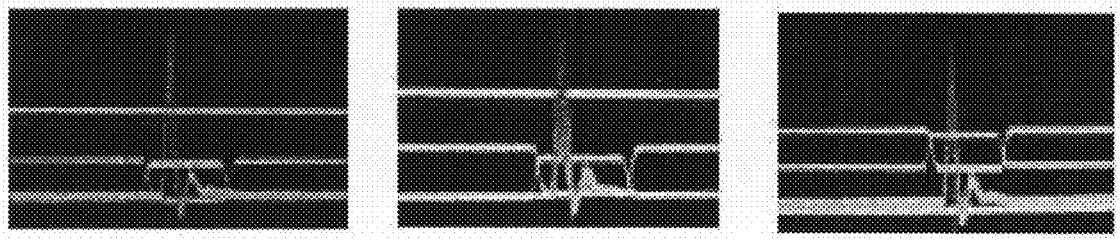
FIG. 9 is a picture illustrating the IR (Infra Red) light emitting of the discharge characteristic of each case (a first case (a), a second case (b), a third case (c)).

FIG. 9 is a picture illustrating the IR (Infra Red) light emitting of the address discharge characteristic of each case (a first case (a), a second case (b), a third case (c)).

As described, since wall charges which are remained immediately after the reset discharge of the second case is smaller than the wall charges of the first case (a) of FIG. 9, it can be known that the address discharge of the second case (b) is unstable in comparison to the first case through the IR light emitting graph shown in (b) of FIG. 9.

Furthermore, in case the novel driving waveform according to the present invention is applied to the auxiliary electrode and the AC PDP having 200 μm coplanar-gap, it can be known that the address discharge is substantially identical with the first case (a) through (c) of FIG. 9.

That is, in case an erase pulse is applied to the auxiliary electrode according to the present invention (the third case (c)), it is an advantage that a stable address discharge characteristic can be obtained with inducing the long gap discharge.

Figure 10:
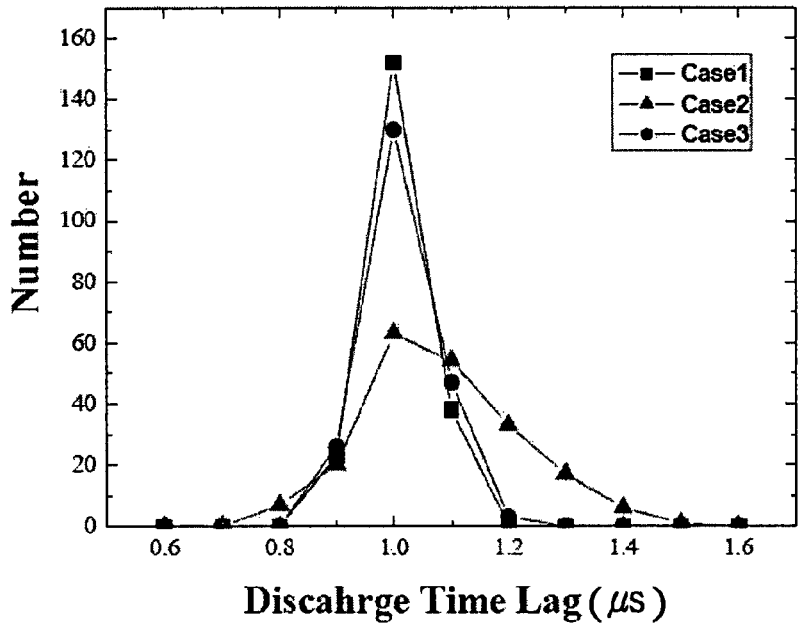
FIG. 10 is a drawing illustrating the distribution of the discharge time lag of the address pulse according to the present invention.

FIG. 10 is a drawing illustrating the distribution of the discharge time lag of the address pulse according to the present invention.

As to the first case (a), the driving waveform of the related art is applied in the AC PDP having 80 μm coplanar-gap. As to the second case (b), the driving waveform of the related art is applied in the AC PDP having 200 μm coplanar-gap without an auxiliary electrode. As to the third case (c), the novel driving waveform according to the present invention is applied in the AC PDP having 200 μm coplanar-gap with an auxiliary electrode.

As shown in FIG. 10, since the graph of the discharge time lag of the second case (b) is more broadened than that of the first case, it can be known that the addressability is not so good. Additionally, as to the third case according to the present invention, regardless of the long gap discharge, it can be known that the addressability with the distribution of the discharge time lag is substantially identical with that of the first case (a).

This result is identical with the description on the distribution of wall charges of FIG. 3B, FIG. 3C, and FIG. 5B described above. During the reset period, the auxiliary electrode affects the distribution of wall charges. In particular, it affects the distribution of wall charges of the address electrode.

That is, positive wall charges are more accumulated in the address electrode than the case where the coplanar-gap without an auxiliary electrode is 200 μm (the second case (b)).

Figure 11:
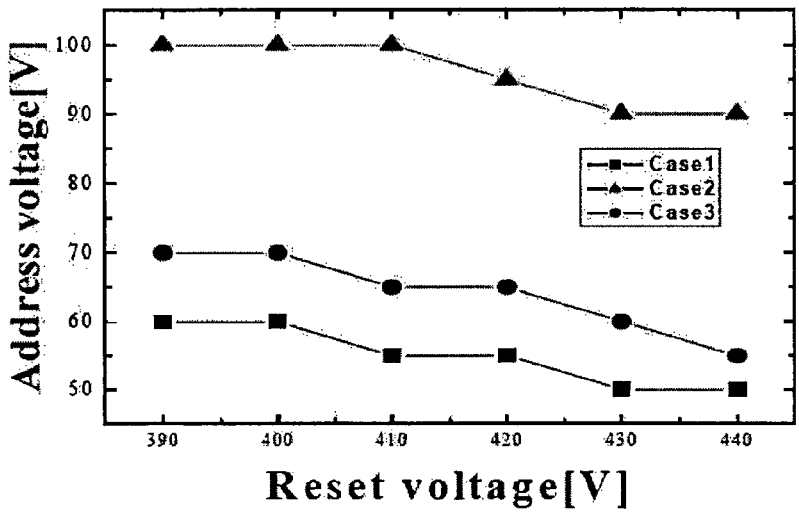
FIG. 11 is a graph illustrating the minimum address voltage according to the function of the reset voltage of each case (a first case (a), a second case (b), a third case (c)).

FIG. 11 is a graph illustrating the minimum address voltage according to the function of the reset voltage of each case (a first case (a), a second case (b), a third case (c)).

In general, due to the increase of the coplanar-gap, the address voltage is increased due to the unstability of the reset discharge, although the gap between the scan electrode and the address electrode is not so much changed. FIG. 11 illustrates the minimum address voltage according to the reset voltage of each case.

The minimum address voltage of the first case (a) rises to 100V when the coplanar-gap is 200 μm. Such address voltage increase is not simply caused by the change of the electrode gap, but caused by the change of the wall charge state which is generated by the change of the coplanar-gap.

However, in case a novel waveform is applied to the AC PDP having an auxiliary electrode and 200 μm coplanar-gap (the third case), it is an advantage that the increase of the minimum address voltage can be remarkably avoidable. That is, it is substantially identical with the minimum address voltage of the first case.

As described in the above, as mentioned on the characteristic of the reset discharge and the address discharge, as to the four electrode AC PDP having an auxiliary electrode where the coplanar-gap is a long gap, a novel waveform is used, in which an erase pulse is applied to an auxiliary electrode according to the present invention.

Accordingly, the increase of the reset voltage due to the long gap discharge and the unstability of the address discharge are stabilized, so that the driving method of a stable four electrode AC PDP having a high efficiency can be provided.

According to the present invention, the reset driving method is used in a four electrode AC PDP for a high efficiency, in which the reset discharge is stabilized by lowering the reset voltage, thereby, the address discharge is stabilized. Thus, the four electrode AC PDP having a high efficiency can be stably drived. The plasma display panel using the method uses a low reset voltage, so that the power consumption is reduced. Hence, the total energy efficiency is increased and a high definition PDP can be implemented due to a stable addressing.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A method of driving a plasma display panel using ADS method comprising a reset period including an erase period, a rising period and a falling period, an address period and a sustain period, in which an auxiliary electrode is inserted between a scan electrode and a sustain electrode which are disposed in parallel on a front substrate, while an address electrode is disposed on a rear substrate facing the front substrate, the method comprising:

applying an erase pulse which rises from a first voltage to a second voltage to the auxiliary electrode in the erase period;

applying a predetermined voltage to the sustain electrode in order that the potential difference with respect to the scan electrode maintains a smaller voltage than a firing voltage, while the auxiliary electrode maintains at least a ground voltage while increasing the voltage which is applied to the scan electrode in the rising period; and respectively applying the predetermined voltage to the auxiliary electrode and the sustain electrode while decreasing the voltage which is applied to the scan electrode in the falling period.

2. The method of claim 1, wherein a last voltage of the falling period applied to the scan electrode and a lowest voltage applied to the sustain electrode and the auxiliary electrode are lower than the ground voltage in the reset period.

3. The method of claim 1, wherein an erase pulse of ramp waveform including a rising period is applied to the sustain electrode in the erase period.

4. A four electrode AC plasma display panel where an auxiliary electrode is inserted between a scan electrode and a sustain electrode which are disposed in parallel on a front substrate, while an address electrode is disposed on a rear substrate facing the front substrate, the four electrode AC plasma display panel using a reset driving method comprising:

applying an erase pulse which rises from a first voltage to a second voltage to the auxiliary electrode in an erase period;

applying a predetermined voltage to the sustain electrode in order that the potential difference with respect to the scan electrode maintains a smaller voltage than a firing voltage, while the auxiliary electrode maintains a ground voltage while increasing the voltage which is applied to the scan electrode in the rising period; and respectively applying the predetermined voltage to the auxiliary electrode and the sustain electrode while decreasing the voltage which is applied to the scan electrode in the falling period.

* * * * *